United States Patent [19]

Clifford

[11] 4,083,349

[45] Apr. 11, 1978

[54] RAPID-FIRE, FLUID ACTUATED B.B. GUN

[76] Inventor: Eugene Russett Clifford, 753 Minorca, Coral Gables, Fla. 33134

[21] Appl. No.: 704,836

[22] Filed: Jul. 13, 1976

[51] Int. Cl.[2] ..... F41B 11/02

[52] U.S. Cl. ..... 124/72; 124/45; 124/83; 124/51 A; 124/71; 124/74

[58] Field of Search ..... 124/72, 51 A, 74, 83, 124/84, 85, 56, 57, 58, 59, 60, 53, 45, 71, 73–74; 89/160, 191, 193

[56] References Cited

U.S. PATENT DOCUMENTS

| | | | |
|---|---|---|---|
| 679,670 | 7/1901 | Hamilton | 124/85 |
| 2,238,384 | 4/1941 | Feltman | 124/72 |
| 2,357,951 | 9/1944 | Hale | 124/72 |
| 3,204,625 | 9/1965 | Shepherd | 124/74 |
| 3,227,148 | 1/1966 | Spack | 124/74 |

FOREIGN PATENT DOCUMENTS

| | | | |
|---|---|---|---|
| 1,203,207 | 7/1959 | France | 124/56 |
| 1,085,636 | 7/1954 | France | 124/56 |

*Primary Examiner*—Richard C. Pinkham
*Assistant Examiner*—T. Brown
*Attorney, Agent, or Firm*—Hill, Gross, Simpson, Van Santen, Steadman, Chiara & Simpson

[57] ABSTRACT

A rapid-fire B.B. pellet-type machine gun operated from a source of gas propellant preferably a canister of liquefield gas, has a trigger-operated valve releasing propellant gas from the source to a pellet containing magazine for projecting the pellets in rapid succession through a barrel passageway to be ejected from the gun at high speed at a target to which the gun is pointed. The pellets underlie and surround a sleeve in the magazine acting as a cofferdam to maintain a local level of the pellets below the gas inlet and the gas outlet so that the gas will impinge against and actuate the pellets causing them to be successively swept into the gas outlet for discharge through the barrel.

19 Claims, 5 Drawing Figures

Fig. 1
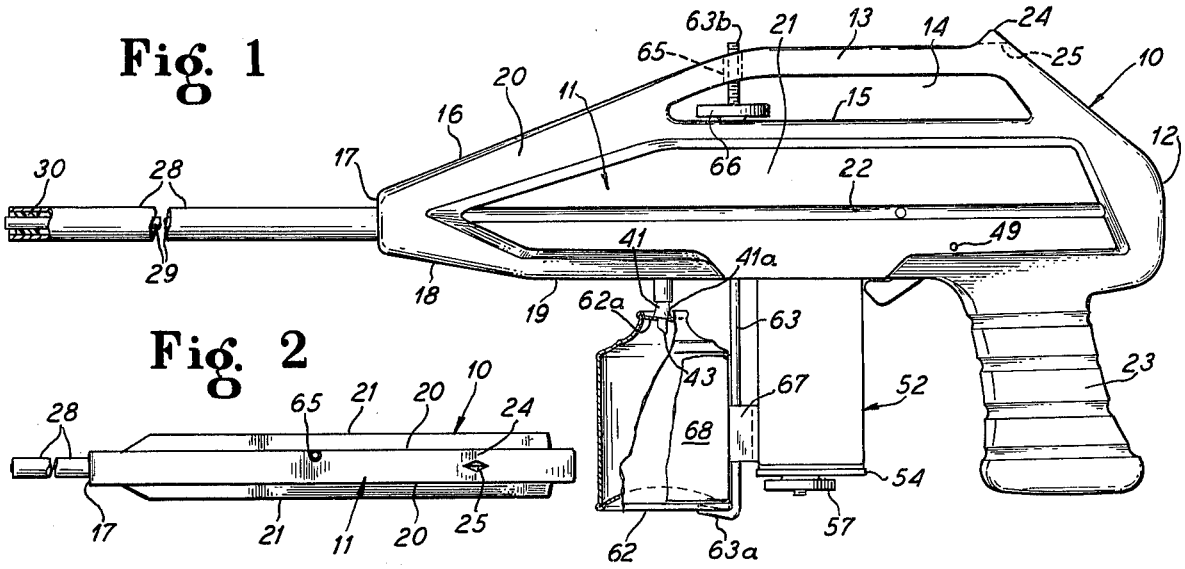
Fig. 2
Fig. 3
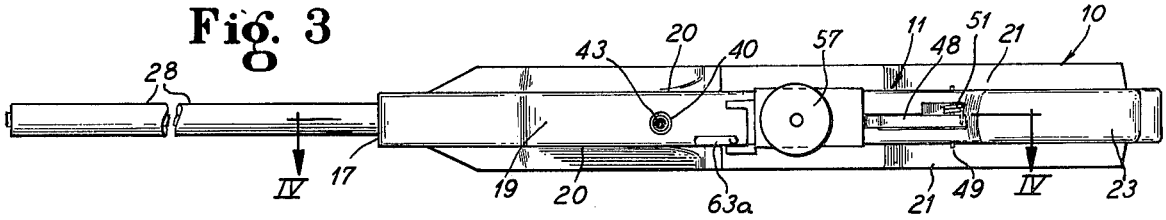
Fig. 4
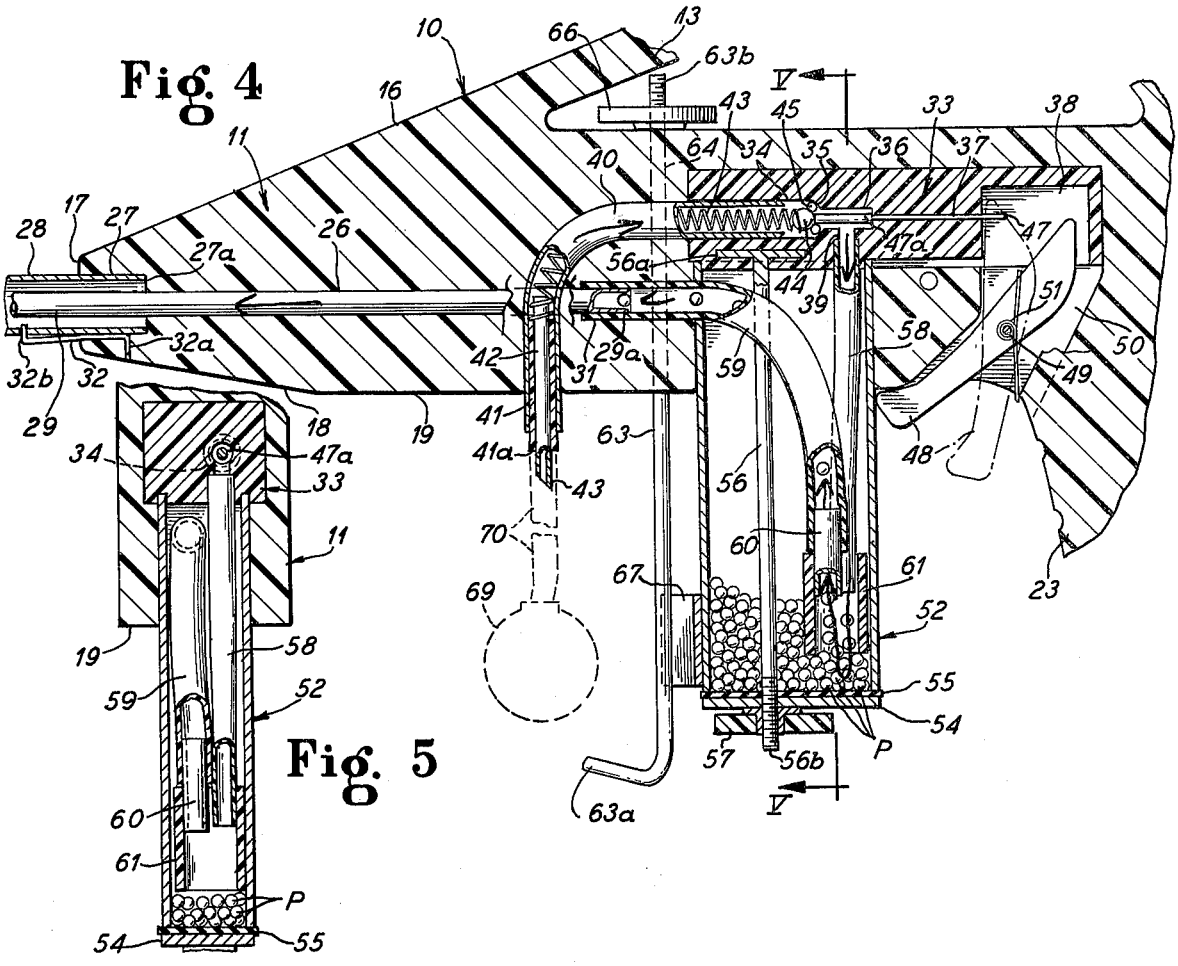

RAPID-FIRE, FLUID ACTUATED B.B. GUN

FIELD OF THE INVENTION

This invention relates to the art of weaponry and particularly to rapid-fire pellet guns. The invention is most particularly concerned with a spherical pellet B.B. gun.

SUMMARY OF THE INVENTION

According to this invention, a rapid-fire submachine gun, capable of ejecting a stream of B.Bs. at high velocity, by merely squeezing a trigger, is activated by a gas propellant from a source such as a detachable canister or tank forming a gas stream through the gun into which the B.Bs. are successively swept from a magazine source carried by the gun.

Specifically, a molded plastics material gun body has a pistol-grip depending from the rear end thereof, and a carrying handle extending along the top thereof with a sighting groove at its rear end. A barrel projects from the front end of the body, and a pellet containing magazine depends from the bottom of the body in front of the grip. A trigger is pivotally mounted rearwardly of the magazine adjacent the grip. A pressure-gas-inlet passageway to the magazine has an exposed conduit end for attachment to a source of gas propellant, preferably a can of liquefied gas such as a fluoro-carbon, butane, propane and the like. A canister suspension clip secures the canister to the gun body in sealed relation with the exposed end of the inlet passageway. A valve chamber in the body has a valve actuated by the trigger receiving gas propellant from the inlet and has an outlet communicating the magazine with the barrel. The gas inlet to the magazine and the gas outlet from the magazine are surrounded by a sleeve which extends close to the bottom of the magazine but is spaced from the bottom to receive the pellets but keep them locally at a level below the inlet and outlet so that the incoming gas wil impinge against the exposed underlying pellets causing them to boil up into the chamber provided by the sleeve and be swept successively into the outlet.

The arrangement is such that when the trigger is squeezed, the valve will be opened admitting propellant gas from the source to the magazine for discharge through the barrel with the pellets in the magazine being swept into the gas stream through the barrel for ejection through the discharge end of the barrel at great velocity in the direction in which the barrel is pointed.

The gun body, of course, can have any desired shape and may, for example, be equipped with a stock to provide a rifle or carbine-type gun. The barrel and barrel cover are preferably composed of metal. The exposed end of the gas inlet conduit is preferably composed of metal with a sharp beveled end for piercing the seal of a liquefied gas propellant canister and with a sealing gasket for engaging the canister seal to prevent leakage.

The conduit from the valve chamber to the magazine and from the magazine to the barrel and the conduit from the piercing end of the gas inlet to the valve chamber are preferably composed of plastics material. The valve is preferably a ball member spring-biased against a seat in the valve chamber. The trigger is preferably spring-biased to a safety position showing the valve to fully seat. The magazine is preferably a metal container having an upper end sealed in the plastics body and a removable cover tightened against an open bottom end by a nut threaded on a stem extending through the magazine. The suspension clip for the propellant canister is preferably a rod with a hooked bottom end engaging the bottom of the canister and a threaded top end receiving a nut bottomed on the gun body under the handle.

The magazine chamber is preferably large enough to hold at least 1,000 spherical-steel or soft-metal B.Bs. of conventional B.B. pellet gun size without being packed tightly enough to prevent free feeding into the sleeve chamber for sweeping into the barrel conduit. The source of propellant gas should not deliver the gas under a pressure much greater than 60 pounds per square inch. Pressures below 60 pounds per square inch will fire B.Bs. from the magazine of a rate of 2,000 to 3,600 rounds per-minute with a 1-second burst delivery about 60 B.Bs.

"Freon 12", a dichlorodifluoromethane supplied by E. I. De Pont deNemours & Co., in sealed canisters for charging automobile air-conditioning systems, is a preferred liquefied gas propellant, and since rapid release of the gas from such a container brings about a cooling or even frosting of the container, it is desired to paint the container black and use the container as a handgrip in combination with the pistol-grip of the gun body for aiming the gun, thereby warming the container.

It is then an object of this invention to provide a rapid-fire pellet gun, especially suited for spherical, B.B. type pellets, which is operated from a source of liquefied gas propellant forming a high velocity gas stream into which the pellets are drawn and discharged from the gun.

Another object of the invention is to provide a rapid-fire submachine gun for ejecting a stream of pellets at a rapid rate and high velocity by merely squeezing the trigger of the gun.

A specific object of the invention is to sweep B.Bs. from a gun magazine into a high velocity gas stream discharging through a gun barrel by providing a cofferdam in the magazine forming a chamber insuring entrainment of the B.Bs. into the gas stream without jamming.

Another object of the invention is to provide an inexpensive B.B. machine gun.

A still further object of the invention is to provide a rapid-fire submachine gun for B.B. type pellets which is activated by a gas propellant conveniently supplied from a canister suspended from the gun.

A specific object of the invention is to provide a rapid-fire B.B. gun having a magazine for storing a large number of B.B. pellets, a suspension device for a canister of propellant gas, a trigger-operated valve releasing gas from the canister to the magazine, and a discharge-barrel communicating with the magazine to receive therethrough gas from the source at a high velocity into which the pellets are swept from the magazine to thereby eject a high velocity stream of pellets at distances of up to 150 yards.

Other and further objects of this invention will become apparent to those skilled in this art from the following detailed description of the annexed sheet of drawings which, by way of a preferred example only, illustrates one embodiment of the invention.

ON THE DRAWINGS

FIG. 1 is a side-elevational view with parts broken away and shown in cross section of a submachine B.B. gun according to this invention.

FIG. 2 is a top-plan view of the gun of FIG. 1 with parts broken away.

FIG. 3 is a bottom-plan view of the gun of FIG. 1 with parts omitted and broken away.

FIG. 4 is an enlarged-fragmentary-longitudinal-sectional view taken along the line IV–IV of FIG. 3.

FIG. 5 is a fragmentary-transverse-sectional view taken along the line V—V of FIG. 4.

AS SHOWN ON THE DRAWINGS

The gun 10 has a one-piece elongated molded plastics body 11 formed in a split die. The plastics material for the body is hard, tough and shock-resistant. A liquid polyester resin-type plastics material is suitable, preferably water-extended for weight reduction.

The molded plastics body 11 has a rear end 12 with an inclined portion sloping forwardly to a longitudinally extending top handle 13. A slot 14 is provided between the handle 13 and the top side 15 of the body. The forward end of the handle merges into a downwardly sloping front portion 16 converging to a reduced diameter front end nose 17. The bottom of the body diverges from the nose 17 along a sloping wall 18 to a flat bottom wall 19. The body has flat sidewalls 20 with raised ribs 21 along the length thereof. These ribs 21 have flat outer faces and reinforce the body providing wider, localized areas along the length of the body. A decorative groove 22 extends longitudinally across the length of the ribs 21.

The body 11 has a pistol-grip 23 depending from adjacent the rear end 12 thereof.

The top end of the sloping portion of the rear end 12 of the body has a raised peak 24 extending above the top face of the handle 13 at the rear end of the handle and a sighting notch 25 is formed through this peak. As shown in FIG. 4, the front end of the body 11 has a longitudinal bore 26 with a counterbore 27 extending inwardly from the nose 17.

A barrel 28 has a barrel tube 29 extending therethrough and secured to the outer end thereof by potting plastics material 30 which holds the tube centrally in the barrel. The tube 29 extends beyond the inboard end of the barrel. This inboard end of the barrel snugly fits the counterbore 27 at the front nose end 17 of the body 11 and is bottomed against a shoulder **27*a* between the counterbore and the bore 26. The barrel tube 29 snugly fits the bore 26 of the body 11 and terminates in a beveled end 29*a* which extends into a counterbore 31 at the inboard end of the bore 26**.

A spring tang 32 locks the barrel 28 in the counterbore 27 and has, as shown in FIG. 4, a downturned end portion **32*a* seated in a hole in the body 11 communicating with a groove in the counterbore 27 and an upturned outer-end portion 32*b* snapped into a hole in barrel 28 just beyond the nose 17**.

The barrel 28 projects forwardly from the nose 17 of the body 11 for a desired distance to provide sufficient guiding of pellets in the barrel tube 29 to direct the steam of pellets emerging from the end of the barrel tube in the direction to which the barrel is pointed.

The barrel 28 and the barrel tube 29, carried thereby, are easily mounted in and removed from the body 11 so that the overall length of the gun may be reduced by removing the barrel to provide a convenient carrying size for the gun with the tang 32 being easily snapped in the hole of the barrel and retracted from this hole to permit removal of the barrel from the counterbore 27, thereby carrying the tube 29 therewith.

As shown in FIGS. 4 and 5, the body 11 has a recess therein receiving a rectangular plastics block 33 which can be composed of the same plastics material as the body or a denser plastics material. The block 33 has a bore 34 extending from its front end thereof to a tapered valve seat 35 which converges to a smaller diameter bore 36. The inboard end of the bore 36 communicates with a still smaller diameter bore 37 extending to an opened bottom recess 38 in the block. A vertical bore 39 in the block intersects the bore 36 intermediate the ends thereof an opens through the bottom of the block.

The bore 34 of the block 33 receives one leg of a metal tube 40 embedded in the body 11 with the other leg of the tube extending beyond the bottom wall 19 of the body. A sleeve 41 of resilient plastics material is seated in this depending leg of the tube 40 and carries a small diameter metal piercing tube 42 with a sharp beveled bottom end 43 projecting beyond the sleeve. The sleeve 41 also projects beyond the tube 40 forming a deformable sealing edge **41*a*. A helical spring 43 fits freely in the tube 40 with one end bottomed on the plastics sleeve 41 and the other end receiving a metal ball 44 engaging a resilient O-ring bottomed on the valve seat 35**.

A pin 47 is slidably mounted in the bore 37 and has a head **47*a* in the bore 36 adapted to engage the ball 44 to displace it from the seat 35 and O-ring 45**.

The pin 47 is actuated by a trigger 48 pivotally mounted on a pin 49 carried by the body 11 in a slot 50 opening through the bottom 19 of the body adjacent the pistol-grip 23. The trigger has a finger-engaging portion projecting beyond the bottom wall 19 of the body and a top-end portion extending into the recess 38 of the block 33 to selectively engage the pin 47. A torsion spring 51 coiled around the pin 49 biases the trigger to the solid-line position of FIG. 4 with the bottom end of the trigger seated against the bottom wall 19 of the body and the top end of the trigger spaced from the pin 47. When the trigger is retracted from the bottom wall 19 of the body and squeezed against the bias of the torsion spring 51, the top end of the trigger will engage the end of the pin 47, causing the head **47*a* of the pin to unseat the ball 44 and opening a passage from the tube 40 to the bore 39**.

A metal, preferably aluminum, rectangular magazine 52 depends from the bottom of the block 33 and through a slot in the body 11 beyond the bottom of the body 19 immediately in front of the trigger 48. This magazine has open ends with the top open end sealed in the block 33 and with the bottom open end closed by a cover 54 and sealing gasket 55. A pin 56 having a head **56*a* molded in the block 33 extends through the magazine 56 and through holes in the cover 54 and gasket 55 and has a threaded end 56*b* receiving a nut 57 adapted to be tightened against the cover 54 to squeeze the gasket 55 between the bottom-end edge of the magazine 52** and the cover, thereby sealing the bottom of the magazine.

A flexible plastics material tube 58 has its upper end seated in the bore 39 of the block 33 and extends therefrom into the magazine to terminate above the bottom end of the magazine. A second flexible plastics material tube 59 has an upper end seated in the bore 31 of the body 11 and snugly embracing the inboard end of the barrel tube 29 so that the end edge **29*a* thereof flares to the inner diameter of the tube. The bottom end of this plastics tube 59 extends into the magazine 52 and receives a metal stand-pipe or tube 60** in the bottom end thereof to provide a fixed diameter entrance to the plastics tube resistant to impingement blows of the B.B. pellets.

A plastics sleeve 61 embraces the stand-pipe 60 and lower end of the plastics tube 58 to hold the same alongside each other as shown in FIG. 5 and to form a depending cofferdam keeping the B.B. pellets at a level below the entrance mouth of the stand-pipe 60 and exit end of the tube 58. The bottom of the sleeve 61 may be about one-half inch above the bottom of the magazine 52 and about the same distance below the stand-pipe 60. The top of the sleeve 61 is substantially closed by the tubes 58 and 59 and the stand-pipe 60 and any gaps are too small to accommodate a flow of B.Bs. into the top of the swirl chamber formed by the sleeve between the bottoms of the tube 58 and stand-pipe 60 and the tops of the B.Bs. underlying the sleeve.

A source of propellant gas such as a conventional canister 62 of refrigerant material such as dichlorodifluoromethane, liquefied butane, propane, carbon dioxide, or the like is mounted in front of the magazine 52 by means of a metal rod clip 63 which is slidable through a vertical bore 64 through the body 11 (FIG. 4) and through a larger bore 65 (FIG. 1) in the handle 13 of the body. The rod has a hook portion 63*a* on the bottom thereof adapted to engage the bottom end of the canister 62 and a threaded portion 63*b* on the top thereof receiving nut 66 in the slot 14 between the handle 13 and the top 15 of the body. The nut 65 when tight against the top 15 of the body will draw the hook-like end 63*a* of the rod 60 tightly against the bottom edge of the canister 62. The canister 62 is equipped with a conventional puncturable seal 62*a* which is pierced by the sharp edge 43 of metal tube 42 with the portion of the seal around the pierced hole being drawn tightly against the sealing edge 41*a* of the plastics sleeve 41 to effect a tight seal between the canister and the tube 40.

A guard bracket 67 preferably composed of a short section of a metal channel strip has the webbing thereof affixed to the front face of the magazine 52 near the bottom end thereof with the side legs straddling the rod 63 and providing abutment edges to bottom the sidewall of the canister 62 so that the canister may be grasped when firing the gun without tilting the canister to break the sealed connection with tube 40.

Since a liquified gas propellant contained in a canister 62, when rapidly released, will lower the temperature of the canister and even form frost thereon, it is desirable to coat the canister with a heat-absorbing coating 68, such as black paint, which will rapidly absorb heat from the hand of the user or from the atmosphere to keep the canister at a comfortable temperature when firing the gun.

In place of a small-gun carried canister such as 62 for supplying propellant gas to the gun 10, the gun may be supplied from a separately supported larger and heavier source such as a tank 69 of compressed air or other gas which is connected to the tube 40 through a flexible hose or tube 70 as shown in dotted lines in FIG. 4. The heavy tank 69 may rest on the ground and the tube or hose 70 may be long enough and flexible enough to permit free manipulation of the gun for target shooting and the like.

From the above descriptions, it will be understood that the magazine 52 is partially filled with B.B. type pellets P. These pellets are readily charged into the magazine by loosening the nut 57 to remove the cover 54 and gasket 55 or to at least permit swinging of the same to open a gap in the bottom of the magazine. It is preferred to leave enough space in the magazine so that the pellets may move freely. When the trigger 48 is squeezed toward the pistol-grip 23, the ball valve 44 will be forced off its seat 35 against the bias of the spring 43 by the head 47*a* of the pin 47, thereby releasing propellant gas from the valve chamber bore 34 upstream of the valve 44 to the bore 36 downstream from the valve to flow through the tube 58 into the chamber provided by the cofferdam sleeve 61 and creating a high velocity gas stream through the stand-pipe 60, tube 59 and barrel tube 29 which stream is discharged to the atmosphere out of the open end of the barrel tube 29 at the end of the barrel 28. The sleeve 61 provides a swirl chamber and the air stream agitates and boils up the B.B. pellets P exposed to the open bottom end of the sleeve 61 sweeping them into the stand-pipe 60 which is sized to freely receive individual pellets therethrough but is small enough to prevent a wedging of a plurality of pellets alongside each other. A stream of successive individual pellets is thus formed and discharged from the outboard end of the barrel tube 29 in the direction in which the barrel 28 is pointed. The pellets P in the magazine 52 surrounding the sleeve will flow into the bottom of the sleeve to replenish the ejected pellets.

The sighting groove 25 enables a person holding the grip 23 with one hand and the canister 68 with the other hand to sight the gun in a lateral direction while the rapidly-issuing "rope" or stream of pellets is visible to correct the aim of the gun in a vertical direction. Because of the rapid-fire capacity of the gun, it can be used for "hip" shooting with a spray of pellets forming the sighting line. When a separately supported tank of propellant gas such as 69 is used, the gun can be operated by grasping the magazine 52 or the forward end of the body 11.

The canister 62 is easily mounted on the gun by placing it at the edge of a table, bench or the like, and then pressing the piercing end 43 of the gas inlet tube 40 through the puncturable seal 62*a* to tightly engage the seal with the sealing edge 41*a* of the tube 41. The hook end 63*a* of the rod 63 is then easily positioned under the bottom of the canister and the nut 66 then is tightened to hold the canister securely in position.

It will, of course, be appreciated that many departures from the herein specifically described embodiment of the invention may be made without departing from the scope of the invention as defined in the appended claims.

I claim as my invention:

1. A rapid-fire B.B. pellet gun adapted to be actuated from a source of liquefied gas propellant which comprises a gun body, a gun barrel extending therefrom, a pellet magazine depending therefrom having a chamber for a stack of pellets, a cofferdam in said magazine having an open bottom close to the bottom of the magazine receiving pellets from said stack at the level of said open bottom, a trigger pivotally mounted on the body, a gas inlet on the body adapted to be connected to a source of liquefied propellant gas, a valve in the body operated by the trigger controlling gas flow from the inlet to the magazine and a conduit opening into the cofferdam above the open bottom thereof connecting said cofferdam with said barrel whereby squeezing said trigger will open said valve to create a gas stream through said magazine feeding pellets from the stack in the magazine through the open bottom of the cofferdam and successively sweeping the pellets from the cofferdam into the conduit for discharge from said barrel.

2. The gun of claim 1 wherein the gun barrel has an inner B.B. tube and an outer cover tube carrying the B.B. tube and terminating short of an extended portion of the B.B. tube, and a said gun body has a passageway receiving the extended portion of the B.B. tube and an apertured nose receiving the terminal end of the cover tube in removable relation.

3. The gun of claim 1 wherein the liquefied gas source is a canister of liquefied gas suspended from the gun body and forming a hand grip for the gun.

4. The gun of claim 3 wherein the canister is covered with a heat absorbing coating.

5. The gun of claim 3 including a clip carried by the gun body for removably securing the canister to the gun body and a backup support on the body for the side wall of the canister.

6. The gun of claim 1 wherein the source of gas is a canister, a rod is slidably mounted through the gun body and has a hooked end for engaging the bottom of the canister and a nut is threaded on the opposite end of the rod to be bottomed on the gun body to draw the hooked end against the bottom of the canister.

7. The gun of claim 1 wherein the cofferdam in the magazine forms a swirl chamber receiving pellets from the magazine and the gas stream.

8. A rapid-fire pellet gun having an upright magazine for receiving a multiplicity of pellets, a pellet discharge outlet, an inlet adapted to be connected to a propellant gas source, passageways connecting the inlet with the magazine and the magazine with the outlet, a sleeve in the magazine having an open bottom close to the bottom of the magazine forming a localized swirl chamber receiving gas from the inlet and exiting gas to the outlet together with pellets from the magazine, a valve controlling gas flow from the inlet to the sleeve, and a trigger for opening said valve, whereby squeezing of the trigger will create a high velocity gas stream from the inlet through the sleeve to the outlet sweeping pellets from the bottom of the magazine and discharging the pellets through the outlet.

9. The gun of claim 8 wherein the inlet and outlet passageways have tube ends depending into the magazine and the sleeve is suspended from these tube ends.

10. The gun of claim 9 wherein the tube ends close the top of the sleeve against ingress of B.Bs. from the magazine.

11. The gun of claim 8 including a clip depending from the gun in front of the magazine to suspend the gas source as a handgrip from the gun.

12. A rapid-fire submachine B.B. gun which comprises a gun body having a grip, a B.B. magazine for a stack of B.B.'s, a sleeve in the magazine receiving B.B.'s from the bottom of said stack, a trigger, a valve chamber, a trigger-operated valve in said chamber, a fluid supply conduit communicating with said valve chamber upstream from said valve and having an external portion adapted to be connected to a source of pressured gas, a fluid delivery conduit communicating with said valve chamber downstream from said valve, a barrel projecting from said gun body having a discharge outlet at the outboard end thereof and communicating at the inboard end thereof with said sleeve above the open bottom of the sleeve, means biasing said valve to a closed position for sealing the fluid supply conduit from the magazine, and means actuated by said trigger for opening said valve to flow fluid from the gas source through the magazine and barrel at a high velocity for sweeping a stream of successive individual B.B.'s from the bottom of the stack in the magazine and through the barrel for ejection of the B.B.'s out of the open end of the barrel.

13. The gun of claim 12 wherein the gun body has a longitudinal carrying handle on the top thereof with a finger slot between the handle and top of the body.

14. The gun of claim 13 wherein the handle has a rear sighting means thereon.

15. The gun of claim 14 wherein the sighting means is a peak on the rear end of the handle with a groove therethrough.

16. The gun of claim 12 wherein the barrel is removable from the gun body and an externally accessible retainer secures the barrel to the body.

17. A rapid-fire pellet gun which comprises a gun body having a front end and a rear end, a grip depending from the rear end, a longitudinal passageway opening at the front end, a valve chamber, a valve in said chamber, a pressure fluid inlet conduit communicating with chamber upstream of said valve, a pressure fluid outlet conduit communicating with said chamber downstream of said valve, a trigger pivotally mounted in said body adjacent said grip, an upright pellet magazine depending from said body, a sleeve in said magazine opening to the bottom of said magazine, a conduit connecting said sleeve above the bottom thereof with said longitudinal passageway, said inlet conduit having an exposed outer end adapted to be connected to a source of pressured gas, said outlet conduit having an end communicating with the upper portion of said sleeve, and means actuated by squeezing said trigger for opening said valve whereby pellets in said magazine will be propelled by the fluid from said source of pressured gas through said longitudinal passageway and out of the front end thereof in rapid high velocity successive relation.

18. The gun of claim 17 wherein the gun body is a molded plastics member with a longitudinal handle along the top thereof.

19. The gun of claim 18 including a slot between the handle and top of the gun body, a clip rod slidable through the body having a nut in the slot threaded thereon and a hook end below the body to engage a canister source of pressured gas.

* * * * *